US005810215A

United States Patent [19]

Plymell

[11] Patent Number: 5,810,215

[45] **Date of Patent: *Sep. 22, 1998**

[54] BASEBALL GLOVE BREAK-IN KIT

[75] Inventor: Jerry Plymell, Duncanville, Tex.

[73] Assignee: Louis S. Orloff, Safety Harbor, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 372,654

[22] Filed: Jan. 13, 1995

[51] Int. Cl.[6] ..... A41D 1/00

[52] U.S. Cl. ..... 223/78

[58] Field of Search ..... 206/315.1, 213.1, 206/205, 278, 216, 213; 223/78; 273/26 C, 58 C; 239/55

[56] References Cited

U.S. PATENT DOCUMENTS

| | | | |
|---|---|---|---|
| 84,787 | 12/1868 | Adamson | 602/19 |
| 328,721 | 3/1885 | Hindar | 602/19 |
| 370,055 | 9/1887 | Haley | 602/19 |
| 1,421,407 | 7/1922 | Clark | 273/58 C |
| 1,633,926 | 6/1927 | Craig | 223/78 |
| 3,338,236 | 8/1967 | McLeod | 602/19 |
| 4,418,849 | 12/1983 | Santa | 223/78 |
| 4,765,519 | 8/1988 | Groves | 223/78 |
| 4,877,162 | 10/1989 | McGinley | 223/78 |
| 4,883,170 | 11/1989 | Wright | 206/315.1 |
| 4,958,729 | 9/1990 | Wright | 206/315.1 |
| 5,000,317 | 3/1991 | Cich | 206/315.1 |
| 5,267,677 | 12/1993 | Nash | 223/78 |

*Primary Examiner*—Theatrice Brown
*Attorney, Agent, or Firm*—Morse & Altman

[57] ABSTRACT

A ball member and a flexible elastic strap with two loops secured together at a connected portion are provided for maintaining the fingers of a baseball glove in a cupped position. The ball member is placed in the pocket of the glove and the fingers of the glove are inserted through one loop and the opposite base end of the glove is inserted through the other loop with the connected portion located against the ball member. In the embodiment disclosed, the ball member is hollow and has a relative stiff outer wall with an opening formed through the wall such that the strap may be inserted through the opening into the interior of the ball member for storage purposes. In one embodiment, the ball member is a spherical ball. In another embodiment the ball member is formed by larger and smaller partially spherical members joined together.

4 Claims, 3 Drawing Sheets

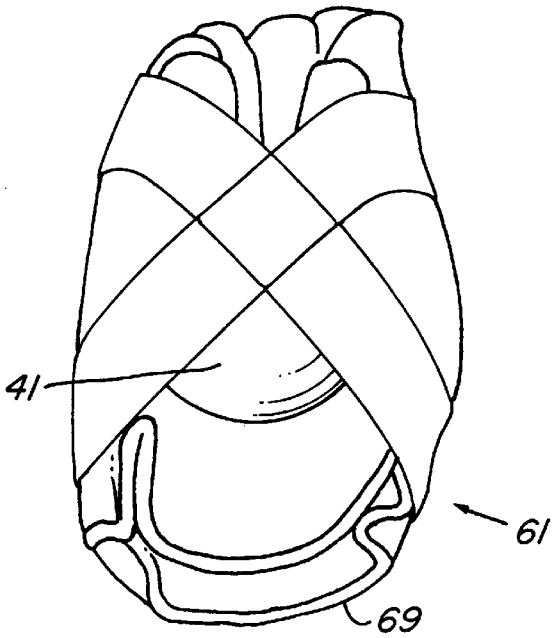
Fig. 1
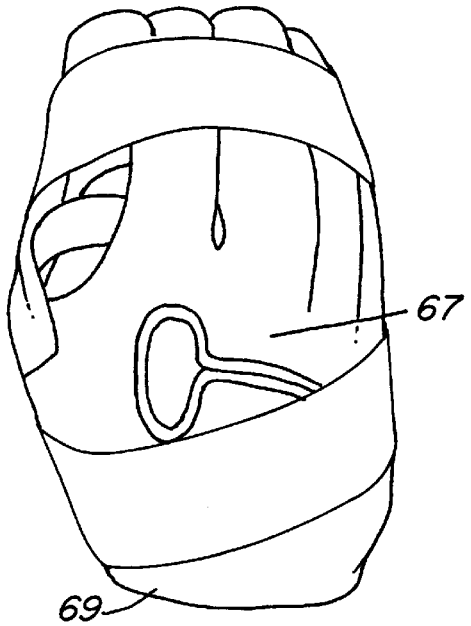
Fig. 2
Fig. 3
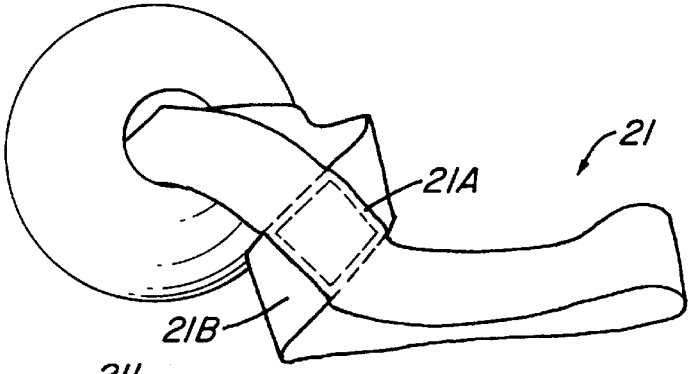
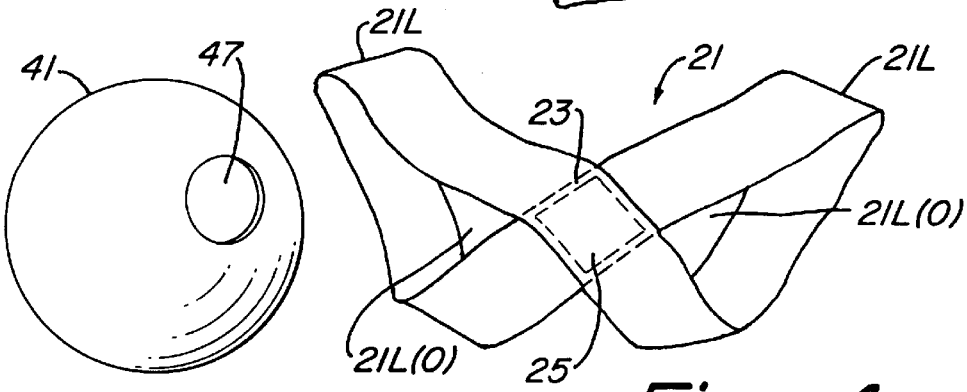
Fig. 4

BASEBALL GLOVE BREAK-IN KIT

BACKGROUND OF THE INVENTION

1. Field of the Invention

The invention relates to a kit for breaking in a baseball glove to allow the fingers of the glove to maintain a cupped or curled position.

2. Description of the Prior Art

In order to obtain optimum use of a baseball glove, the fingers thereof should normally be in a curled or cupped position around the pocket to facilitate catching a baseball. The fingers of a new glove, however, are not as curled or cupped as desired. Moreover, the fingers of a glove after use can also move or stretch out of the desired curled or cupped position.

SUMMARY OF THE INVENTION

It is an object of the invention to provide a special strap and a specifically designed ball with instructions and instructional video comprising a kit for breaking in a new glove or maintaining a used glove in a position such that its fingers or gripping portions will always have the desired curled or cupped position.

The kit comprises a ball member having a size sufficient to fit in the pocket of a ball glove with the fingers or ball gripping portions wrapped around the ball member and a flexible elastic strap forming two loops secured together defining a connection portion such that one loop may be stretched around the outer side of the glove including the fingers or ball gripping portions and the other loop may be stretched around the outer side of the glove including the base with said connection portion located against the ball member to maintain the fingers or ball gripping portions of the glove curled around the ball member.

In the embodiment disclosed, the ball member has an inner cavity with a relatively stiff outer wall with a relatively small opening formed through the wall to allow the strap to be inserted through the opening into the inner cavity of the ball member when not in use and removed therefrom for use.

In one embodiment, the ball member is a spherical ball. In another embodiment the ball member is formed by larger and smaller partially spherical members joined together.

BRIEF DESCRIPTION OF THE DRAWINGS

FIG. 1 illustrates the ball of the invention located in the pocket of a baseball glove with the strap of the invention securing the fingers in a curled position around the ball.

FIG. 2 illustrates the back side of the glove of FIG. 1.

FIG. 3 illustrates the strap of FIGS. 1 and 2 being inserted or removed from the interior of the ball.

FIG. 4 illustrates the strap and ball of the invention.

DESCRIPTION OF THE PREFERRED EMBODIMENTS

Figure 6:
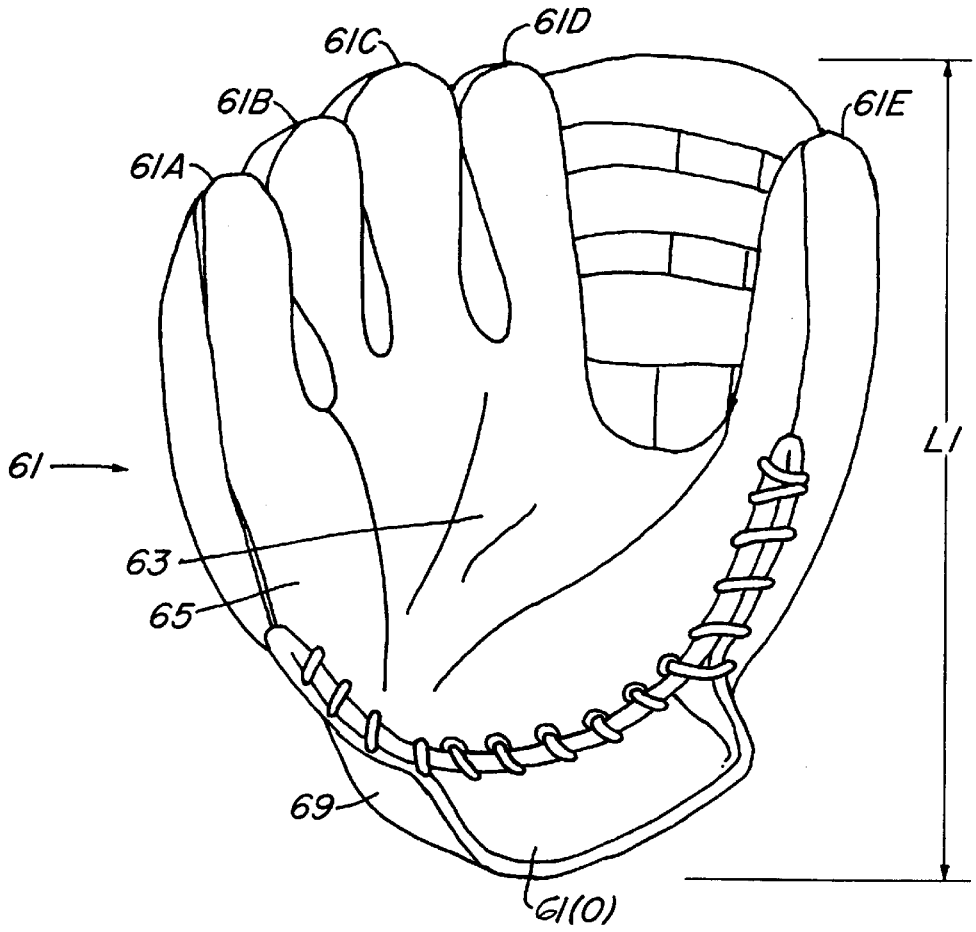
FIG. 6 illustrates a baseball glove showing its pocket.
Figure 5:
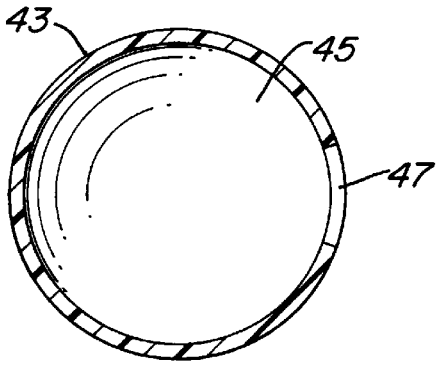
FIG. 5 is a cross-sectional view of the ball of the invention.

Referring now to the drawings, the kit of the invention comprises an elastic strap 21 and a ball 41 for use for maintaining the fingers 61A–61E or ball gripping portions of the baseball glove 61 normally curled or cupped about its pocket 63. As shown in FIGS. 1 and 6, the glove 61 has an opening 61(0) into which one's hand will be inserted for using the glove for playing purposes. The strap 21 is formed of a continuous thin but wide elastic member which is twisted 180 degrees such that portions 21A and 21B cross each other with the cross over portions 25 being sewed together with thread 23 to form a FIG. 8 with two elastic loops 21L with openings 21L(0). The ball 41 has a relatively stiff outer shell or wall 43 defining interior cavity 45 with a round opening 47 formed through the wall 43 leading to the cavity 45.

In using the kit, the ball is located in the pocket 63 on the inner side 65 of the glove and one of the loops 21L is stretched around the outer side 67 of the glove 61 with its fingers in its opening 21L(O) and the other loop 21L is stretched around the outer side 67 of the glove with its base portion 69 in its opening 21L(O) such that the fingers of the glove are curled around the ball. In the looping procedure, the sewn cross-over portion 25 will be located on the side 65 of the glove against the ball 41. This looping procedure is done when the glove is not in use such that the fingers will retain the curled shape when the strap is removed and the glove is to be used. This looping or curling procedure may be carried out on a new glove or a used glove. When the glove is to be used, the strap is removed.

When the ball 41 and strap 21 are not in use, the strap 21 is inserted into the cavity 45 of the ball by way of the opening 47 for storage purposes. A rag for oiling the glove also may be stored in the cavity 45. When the ball and strap are to be used, the strap 41 is removed from the cavity 45 by way of the opening 47.

In one embodiment, the specially design strap 21 is formed of a flexible elastic material of the type which may be stretched or expanded and when released it will resume its former shape. The strap may have a thickness of less than 1/16 th of an inch and a width of about 2 inches. The diameter of each loop when unstretched may be about 4 inches. The ball 41 may be formed of a suitable plastic stiff enough such that it is difficult for a person to push its wall inward by the use of ones fingers. The ball may be formed of a suitable polyurethane. The ball 41 also may be formed of other stiff material such as wood. In this case, two hemispheres may be formed and glued together to form a hollow round ball and the opening 47 formed through its wall. For use with a conventional softball glove, formed of leather and having a length L1 of about 12 inches and an outer circumference between fingers 21A and 21E of about 14 inches, the strap 21 may have the dimensions mentioned above, and ball may an outer diameter of about 4 1/12 inches. The round opening 47 may have a diameter of about 1¾ inches. The invention also may be used to curl the pads or ball gripping portions of a catchers mitt.

It is to be understood that the strap 21 and ball 41 may have dimensions different from that listed above, depending on the size of the glove with which they are to be used. For example, for use with a hard ball and a conventional baseball glove, the ball may have an outer diameter of about 4 inches.

Figure 7:
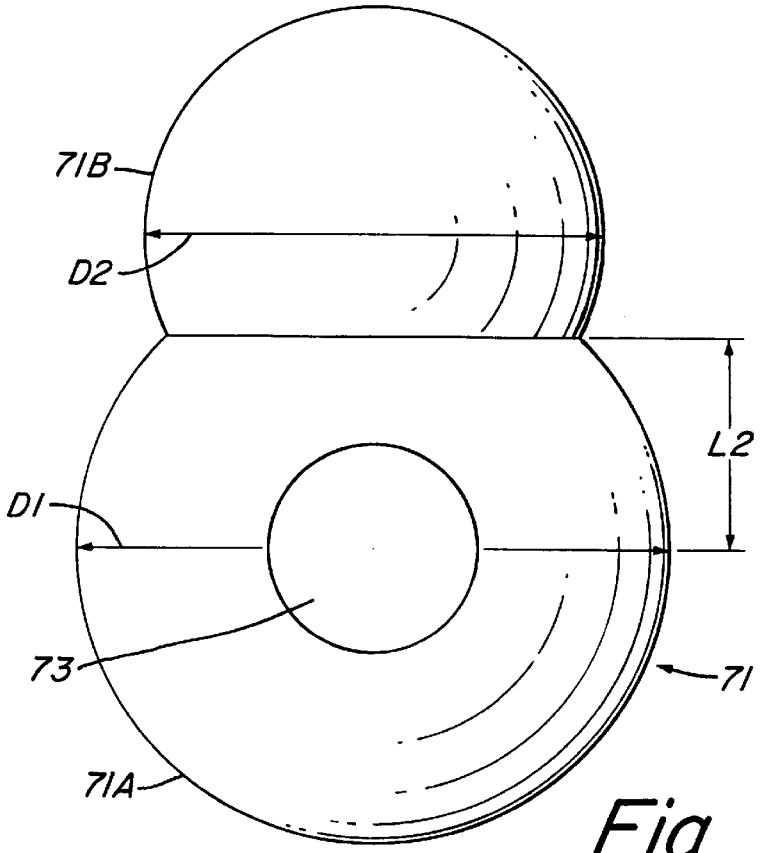
FIG. 7 is a side view of the preferred embodiment of the ball.
Figure 8:
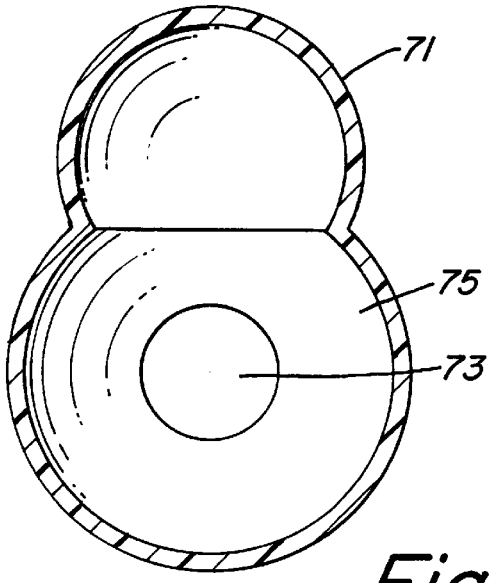
FIG. 8 is a cross-section of the ball of FIG. 7.

The preferred pocket forming ball member is shown at 71 in FIGS. 7 and 8. It comprises two hollow partial sphere members 71A and 71B formed together and having an opening 73 formed through member 71A. The wall of the member 71 is relatively stiff. The partial sphere member 71A is larger than partial sphere member 71B. For forming or maintaining the pocket of a softball glove, the smaller member 71B is placed in the pocket of the glove with the larger member 71A extending outward to form a smaller pocket with a larger opening. The strap 21 is fitted around the glove as shown in FIGS. 1 and 2 with one of the cross over portions 25 engaging the larger member 71A.

To form or maintain the pocket of a baseball glove, the larger member 71A is placed in the pocket of the glove with the small member 71A extending outward. The strap 21 is fitted around the glove as shown in FIGS. 1 and 2 with one of the cross-over portion 25 engaging the smaller member 71B to form a larger pocket with a smaller opening.

The member 71 may be formed of a suitable polyurethane and have a wall thickness of ⅛ of an inch. The opening 73 is used to insert the strap 21 and instructional material into the interior 75 of the member 71 for storage purposes. Diameter D1 may be 4½ inches; diameter D2 may be 3½ to 3¾ inches; dimension L2 may be about 1⁹⁄₁₆ inches; and the diameter of opening 73 may be 1¾ inches.

The ball member, strap and a glove oiling rag with instructions and instructional video may be sold together as a kit.

In this application, by baseball glove is meant any type of glove whether used with a "hard" ball or a "soft" ball used in the game and by baseball is meant a "hard" or "soft" ball used in the game.

I claim:

1. A kit for use with a ball glove of the type having an inner side, an outer side, a pocket, ball gripping portions, a base portion, and an opening for receiving the hand of a person, said kit comprising:

(a) a member having a size sufficient to fit in said pocket with said ball gripping portions curled around said member, said member including a larger partial spherical portion greater than a half-sphere and a smaller partial spherical portion greater than a half-sphere, said spherical portions fixedly joined together and engaging each other; and (b) a flexible, elastic strap forming two loops secured together defining a connection portion such that a first of said loops may be stretched around said outer side of said glove including said ball gripping portions and a second of said loops may be stretched around said outer side of said glove including said base portion, with said connection portion located against said member to maintain said ball gripping portions curled around said member.

2. The kit of claim 1 wherein said strap comprises a thin, flat, continuous member twisted about 180 degrees such that strap portions cross each other at said connection portion to form said two loops.

3. The kit of claim 1 wherein said member has an inner cavity with a relatively stiff outer wall and a relatively small opening formed through a wall of one of said partial spherical portions to provide a passage into and out of said inner cavity, said opening being large enough to allow said strap to be inserted through said opening into said inner cavity when not in use and removed therefrom for use.

4. The kit of claim 3 wherein said strap comprises a thin, flat, continuous member twisted about 180 degrees such that strap portions cross each other at said connection portion to form said two loops.

* * * * *